US006265715B1

(12) United States Patent
Perreault et al.

(10) Patent No.: US 6,265,715 B1
(45) Date of Patent: Jul. 24, 2001

(54) NON-POROUS MEMBRANE FOR MALDI-TOFMS

(76) Inventors: Helene Perreault; Art Chow; Werner Ens; Harry Duckworth; Lynda Donald; Richard Oleschuk; Darren Manley; Mark McComb; Kenneth Standing; Joe O'Neil, all of 631 Drake Centre, Winnpeg, Manitoba (CA), R3C 3Z3

( * ) Notice: Subject to any disclaimer, the term of this patent is extended or adjusted under 35 U.S.C. 154(b) by 0 days.

(21) Appl. No.: 09/239,547

(22) Filed: Jan. 29, 1999

Related U.S. Application Data

(60) Provisional application No. 60/073,364, filed on Feb. 2, 1998.

(51) Int. Cl.[7] ..... H01J 49/04
(52) U.S. Cl. ..... 250/288; 250/287
(58) Field of Search ..... 250/288, 287

(56) References Cited

U.S. PATENT DOCUMENTS

| | | | | |
|---|---|---|---|---|
| 4,527,059 | * | 7/1985 | Benninghoven et al. | 250/288 |
| 5,239,036 | * | 8/1993 | Krishnan | 528/28 |
| 5,260,571 | | 11/1993 | Cottrell et al. | 250/288 |

OTHER PUBLICATIONS

McComb et al., Rapid Communications in Mass Spectrometry, vol. 11, 1716–1722 (1997).
Preston et al., Biological Mass Spectrometry, vol. 22, 544–550 (1993).
Zaluzec et al. American Society for Mass Spectrometry, vol. 5, 230–237 (1994).
Bornsen et al. Rapid Communications in Mass Spectrometry, vol. 9, 1031–1034 (1995).
Worrall et al. Analytical Chemistry, vol. 70, 750–756 (1998).
Blackledge et al. Analytical Chemistry, vol. 67, 843–848 (1995).
Vestling et al. Mass Spectrometry Reviews, vol. 14, 169–178 (1995).
Zhang et al. Journal of Mass Spectrometry, vol. 31, 690–692 (1996).
Schreiner et al. Electrophoresis, vol. 17, 954–961 (1996).
Vestling, "Time of Flight Mass Spectrometry", Chapter 12, American Chemical Society, 211–224 (1994).

(List continued on next page.)

*Primary Examiner*—Jack Berman
(74) *Attorney, Agent, or Firm*—Michael R. Williams; Adrian D Battison; Ryan W. Dupuis

(57) ABSTRACT

The use of non-porous membranes as sample supports for MALDI-TOFMS analysis of peptides and proteins as well as for the analysis of whole blood is herein described. Non-porous membranes have a uniform surface, allowing for greater sensitivity and accuracy. Specifically, the non-porosity favours crystal growth on the surface of the membrane only, thereby providing enhanced spectral quality over membranes with porous structures. Studies were performed using polyurethane (PU) membranes as an example of non-porous MALDI sample supports and showed that PU membranes yielded higher quality spectra compared with porous membrane sample supports such as polyether and poly(vinyl difluoride) and the spectra obtained from PU membranes are of comparable quality as those obtained with metallic targets. However, the sample preparation for use with PU membranes is much less arduous compared with the preparation necessary for metallic targets. On membrane proteolytic digestions of proteins were performed using trypsin. After the completion of the digests, buffer components were washed of leaving peptides bound to the membrane. Addition of matrix followed by MALDI analysis resulted in good quality mass spectra which enabled peptide mapping.

12 Claims, 16 Drawing Sheets

OTHER PUBLICATIONS

Mortz et al., Biological Mass Spectrometry, vol. 23, 249–261 (1994).
Bai et al. Analytical Chemistry, vol. 67, 1705–1710 (1995).
Rouse et al. Analytical Biochemistry, vol. 238, 82–92 (1996).
Vestling et al., Analytical Chemistry, vol. 66, 471–477 (1994).
Hutchens et al., Rapid Communications in Mass Spectrometry, vol. 7, 576–580 (1993).
Brockman et al. Analytical Chemistry, vol. 67, 4581–4585 (1995).
Houston et al. Rapid Communications in Mass Spectrometry, vol. 11, 1435–1439 (1997).
Witkowska et al. Hemoglobin, vol. 17, 227–242 (1993).
Chace et al., Clinical Chemistry, vol. 41, 62–68 (1995).
Prome et al., Biomedical and Environmental Mass Spectrometry, vol. 16, 41–44 (1988).
Wada et al., Mass Spectrometry Reviews, vol. 8, 379–434 (1989).
Witkowska et al., Journal of Mass Spectrometry and Rapid Communications in Mass Spectrometry, S111–S115 (1995).
Light–Wahl et al., Biological Mass Spectrometry, vol. 22, 112–120 (1993).
Shackleton et al. Journal of Chromatography, vol. 562, 175–190 (1991).
Warren et al., Analytical Chemistry, vol. 70, 3757–3761 (1998).
Karas et al., Mass Spectrometry Reviews, vol. 10, 355–357 (1991).
Brockman et al., Rapid Communications in Mass Spectrometry, vol. 10, 1688–1692 (1996).
Brockman et al., Analytical Chemistry, vol. 69, 4716–4720 (1997).
Strupat et al., "Mass Spectrometry in the Biological Sciences", 203–216 (1996).
Miyazaki et al., Journal of Mass Spectrometry, vol. 31, 1311–1313 (1996).
Walker et al., Analytical Chemistry, vol. 71, 268–272.
Shackleton et al. Analytical Chemistry, vol. 68, 29A–33A (1996).
Hannon et al. NCCLS. Blood Collection on Filter Paper for Neonatal Screening Programs; Approved Standard—Third Edition. NCCLS document LA4–A3 (ISBN 1–56238–334–5), 1997.

* cited by examiner

NON-POROUS MEMBRANE FOR MALDI-TOFMS

This appln claims the benefit of Provisional No. 60/073,364 filed Feb. 2, 1998.

The present invention relates to a non-porous membrane for use as a sample support in matrix-assisted laser desorption time-of-flight mass spectrometry.

BACKGROUND OF THE INVENTION

Within the last decade, with the advent of electrospray ionization (ESI) and matrix-assisted laser desorption/ionization (MALDI), mass spectrometry has been shown to be able to contribute to the rapid, sensitive and accurate characterization of biomolecules. These techniques have allowed for the development of mass spectrometry-based methods for investigation of biomolecular structure and function. However, in order to achieve the best analysis, these techniques must be performed quickly, accurately and with a minimum of sample loss.

For example, matrix-assisted laser desorption/ionization time-of-flight mass spectrometry (MALDI-TOFMS) (Karas et al., 1991, *Mass Spectrom. Rev.* 10:335, Hillenkamp and Karas, 1990, *Meth. Enzym.* 193:280, Zaluzec et al., 1995, *Prot. Exp. Purifification* 6:109) provides a rapid and convenient means for the characterization of proteins and peptides derived from biological samples. This method has the advantage of being relatively tolerant of impurities, such as salts and buffers. As a result, molecular ions of peptides and proteins can still be produced by MALDI, even with salts or buffers at concentrations which would hamper other ionization processes such as electrospray ionization (ESI). Delayed extraction, combined with reflecting time-of-flight mass analysis, provides high resolution and allows accurate mass measurements for sample components in the parts-per-million range, even for fairly complex mixtures (Vestal et al., 1995, *Rapid Commun. Mass Spectrom.* 9:1044). In spite of the relative tolerance to impurities mentioned above, biologically derived samples must still be isolated and purified prior to analysis to obtain the best results. Specifically, MALDI analysis of complex mixtures is often hindered by the suppression or quenching of the signals from some analytes. In addition, the presence of impurities may inhibit the formation of matrix-analyte crystals suitable for the MALDI ionization process. The impurities may also lead to the formation of adducts which will degrade the resolution and mass accuracy of the results. Typically, this is overcome by purification of the sample prior to analysis.

Several methods of sample purification prior to MALDI-TOFMS analysis have been developed including dialysis and chromatography. Both methods have limitations, such as sample loss and time-consuming sample preparation. Alternatively, the desired analytes may be removed from the sample using affinity binding-based purification methods. Specifically, these methods selectively retain and concentrate the analytes of interest; however, these methods are time-consuming which may in turn result in degradation of the target analytes.

A different approach is to carry out the purification on the MALDI probe surface itself, which avoids many sources of sample loss. For example, a small amount of powdered chromatographic packing placed on the MALDI target allows for the selective removal of interfering components (Rouse and Vath, 1996, *Anal Biochem.* 238:82). Surface modified agarose beads have also been used for this purpose (Hutchens and Yip, 1993, *Rapid Commun. Mass Spectrom.* 7:576). Furthermore, the use of films for sample supports for MALDI mass spectrometry of impure samples was patented by John S. Cottrell (U.S. Pat. No. 5,260,571), which discloses the application and use of thin films on the surface of the MALDI probe as a method of preparing a sample for analysis. An alternative technique consists of chemically modifying the probe surface by the addition of coatings such as nitrocellulose (Liu et al., 1995, *Anal. Chem.* 67:3482) and Nafion (Bai et al, 1994, *Anal. Chem.* 66:3423). As an extension of this approach, C-18 derivatized targets have been prepared (Brockman et al., 1997, *Anal. Chem.* 69:4716). Basically, if the analyte of interest is selectively adsorbed onto the modified probe, interfering substances can be washed off, while the analyte is retained. However, in the aforementioned examples, modification of the probe surface for sample binding is time-consuming and the probes are good for only a limited number of uses. In addition, samples must still be transported to the MALDI-TOFMS laboratory by conventional means, that is, in solution and on ice.

Similarly, MALDI-TOFMS has been used recently to analyze hemoglobin from whole blood (Houston and Reilly, 1997, *Rapid Commun. Mass Spectrom.* 11:1435). Rapid screening for hemoglobin abnormalities is of great importance as many health authorities now require the screening of new-borns' blood for hemoglobin-related diseases, as it has been shown that early detection of sickle cell disease significantly reduces infant mortality rates from this disease (Vichinsky et al., 1988, *Pediatrics* 81:749). In the Houston and Reilly protocol (supra), whole blood samples are diluted and mixed with matrix solution. The resulting mixture is placed on a stainless steel MALDI probe and allowed to dry. While the MALDI spectra obtained with this method are of good quality, sample preparation requires a skilled mass spectrometrist familiar with MALDI matrix preparation methods. In addition, the analysis needs to be performed immediately or the sample processed and stored on ice.

The use of membranes as sample supports has recently been adopted as a means of both sample purification and sample delivery into the mass spectrometer (Vestling and Fenselau, 1995, *Mass Spectrom. Rev.* 14:169; Strupat et al. in *Mass Spectrometry in the Biological Sciences*, A. L Burlingame and S. A. Carr editors, Humana Press: Totowa, N. J., 1996) p203). Several different membranes have been used for sample supports for MALDI mass spectrometry, two examples of which are: poly(vinylidene difluoride) (PVDF) (Vestling and Fenselau, 1994 *Anal. Chem.* 66:4371; Strupat et al., 1994, *Anal. Chem.* 66:464) and polyether (Blackledge and Alexander, 1995, *Anal. Chem.* 67:843). Specifically, these membranes have been used to prepare samples for MALDI-TOFMS from solution or following sodium dodecyl sulfate-polyacrylamide gel electrophoresis (SDS-PAGE). That is, purification of the analyte sample is performed prior to MALDI analysis. It is of note that deposition of aqueous protein solutions onto membrane supports has been shown to enhance MALDI signals for samples containing buffer components in higher concentrations than can generally be tolerated with traditional protocols. Subsequent purification by on-probe washing and/or enzymatic digestion results in low sample loss since proteins and peptides are bound fairly strongly to the membrane by ionic and hydrophobic interactions. However, the above-described membranes are porous and therefore have a heterogeneous surface which reduces the accuracy, sensitivity and resolution of the analysis. Specifically, the porosity permits distribution of the analyte and matrix within the membrane (Blackledge and Alexander, 1995, *Anal Chem.* 67:843). This distribution of analyte within the porous surface reduces the amount of analyte available near the top of the membrane for sampling with the laser to bring about a MALDI-MS spectrum. Thus, increased laser irradiance is required to penetrate deep into the pores. This increased laser irradiance results in charging which causes an increase in the flight time, which significantly reduces spectral quality compared with metallic targets. The distribution also results in a non-uniform initial starting point for ions, again reducing the spectral quality by reducing the resolution.

Here we report the use of non-porous membranes as sample supports on MALDI probes. The membranes have a uniform surface, allowing for greater sensitivity and accuracy. Specifically, the non-porosity favours crystal growth on the surface of the membrane only, thereby providing enhanced spectral quality over membranes with porous structures. Studies were performed using polyurethane (PU) membranes as an example of non-porous MALDI supports. While PU membranes have been used previously for the separation and concentration of neutral metal complexes and organic dyes from aqueous solution (Oleschuk and Chow, 1996, *Talanta* 43:1545; Rzeszutek and Chow, *Talanta*, in press), they have not previously been used as probes for MALDI analysis. PU membranes possess a unique two-phase structure consisting of hydrophobic soft domains and relatively hydrophilic hard domains, and proteins and lipids have been shown to adsorb through hydrophobic interaction with the soft domains of the polymer (Sreenivasan et al., 1992, *J. Appl Polym. Sci.* 45:2105). PVDF and PE, in addition to other membranes used for sample supports, typically bind through hydrophobic and ionic interactions depending on the material. The PU is unique as the soft segments will bind through hydrophobic type interactions with a strength that is somewhat weaker and hence more reversible than PVDF which binds proteins quite strongly. This binding property of the soft segments of the PU membrane allows more analyte to be removed from the surface of the membrane into the matrix solution which in turn results in more sample available for MALDI analysis. The PU membrane also swells upon the addition of methanol which increases the effective surface area available for protein binding. As a result, the PU membranes offer greater sensitivity for MALDI analysis.

The use of PU membranes as sample supports for MALDI-TOFMS analysis of peptides and proteins as well as for the analysis of whole blood is herein described. It is of note that non-porous membranes may be used, for example, as supports for analyzing blood plasma, cerebral fluid, spinal fluid, saliva, tears and other biofluids as well as for enviromonitoring and the like.

SUMMARY OF THE INVENTION

According to one aspect of the invention there is provided a non-porous membrane for use as an analyte sample support for matrix-assisted laser desorption/ionization time of flight mass spectrometry analysis of biomolecules.

Preferably, the non-porous membrane has a homogenous, uniform surface. The non-porosity favours crystal growth on the surface of the membrane only, thereby providing enhanced spectral quality over membranes with porous structures.

The non-porous membrane may be composed of polyurethane. Polyurethane membranes possess a unique two-phase structure consisting of hydrophobic soft domains and relatively hydrophilic hard domains, and proteins and lipids have been shown to adsorb through hydrophobic interaction with the soft domains of the polymer.

According to a second aspect of the invention, there is provided a method of preparing an analyte sample for matrix-assisted laser desorption/ionization time of flight mass spectrometry analysis, comprising:

(a) providing a non-porous membrane as a sample support;

(b) providing a matrix solution;

(c) applying the analyte sample directly to the non-porous membrane;

(d) allowing the analyte sample to dry;

(e) applying the matrix solution to the sample; and (f) allowing the analyte sample to dry.

Preferably, the non-porous membrane is composed of polyurethane. Polyurethane membranes possess a unique two-phase structure consisting of hydrophobic soft domains and relatively hydrophilic hard domains, and proteins and lipids have been shown to adsorb through hydrophobic interaction with the soft domains of the polymer.

Preferably, the method includes the additional steps of adding methanol to the analyte sample and allowing the analyte sample to dry prior to or following step (d). The addition of methanol to analyte samples deposited on the PU membrane causes swelling of the polyurethane which leads to enhanced protein sorption. Specifically, addition of methanol may cause disruption of the intermolecular forces holding the polymer chains together, thereby allowing an increase in the effective surface area available for protein sorption. Methanol also facilitates the partition of proteins and peptides from more polar components, for example salts.

The analyte sample may be whole blood. Specifically, the analyte sample may comprise a droplet of blood and said analyte sample may be applied directly to the non-porous membrane. That is, the droplet of blood is applied directly to the polyurethane membrane without any pre-treatment.

Preferably, the method includes the step of washing the analyte sample prior to step (e). In this manner, salts and the like may be removed from the analyte sample, thereby improving spectral quality. The washing solution may comprise for example, water, acidified water, (a dilute trifluoroacetic acid solution, formic acid or acetic acid).

Preferably, the method includes the steps of adding a proteolytic enzyme in a buffering solution to the analyte sample, allowing digestion of the analyte sample to occur and removing the buffering solution by washing the analyte sample prior to step (e).

Preferably, the method includes the step of adding additional analyte sample to the dried sample prior to step (e). In this manner, the analyte sample may be further concentrated.

The analyte solution may be extracted from a mixture. The analyte solution may be extracted from the mixture by placing the non-porous membrane in contact with the mixture. It is of note that in this instance, the analyte must have an affinity for the membrane. In this manner, the analyte sample may be extracted from a mixture of samples and/or impurities and concentrated onto the non-porous membrane by placing the membrane in a solution containing the analyte sample. The mixture may be a biological sample, for example, whole blood, blood plasma, cerebral fluid, spinal fluid, saliva, or tears. Furthermore, the above-described process may be carried out in vivo.

One embodiment of the invention will now be described in conjunction with the accompanying drawings in which:

BRIEF DESCRIPTION OF THE DRAWINGS AND TABLES

Figure 10:
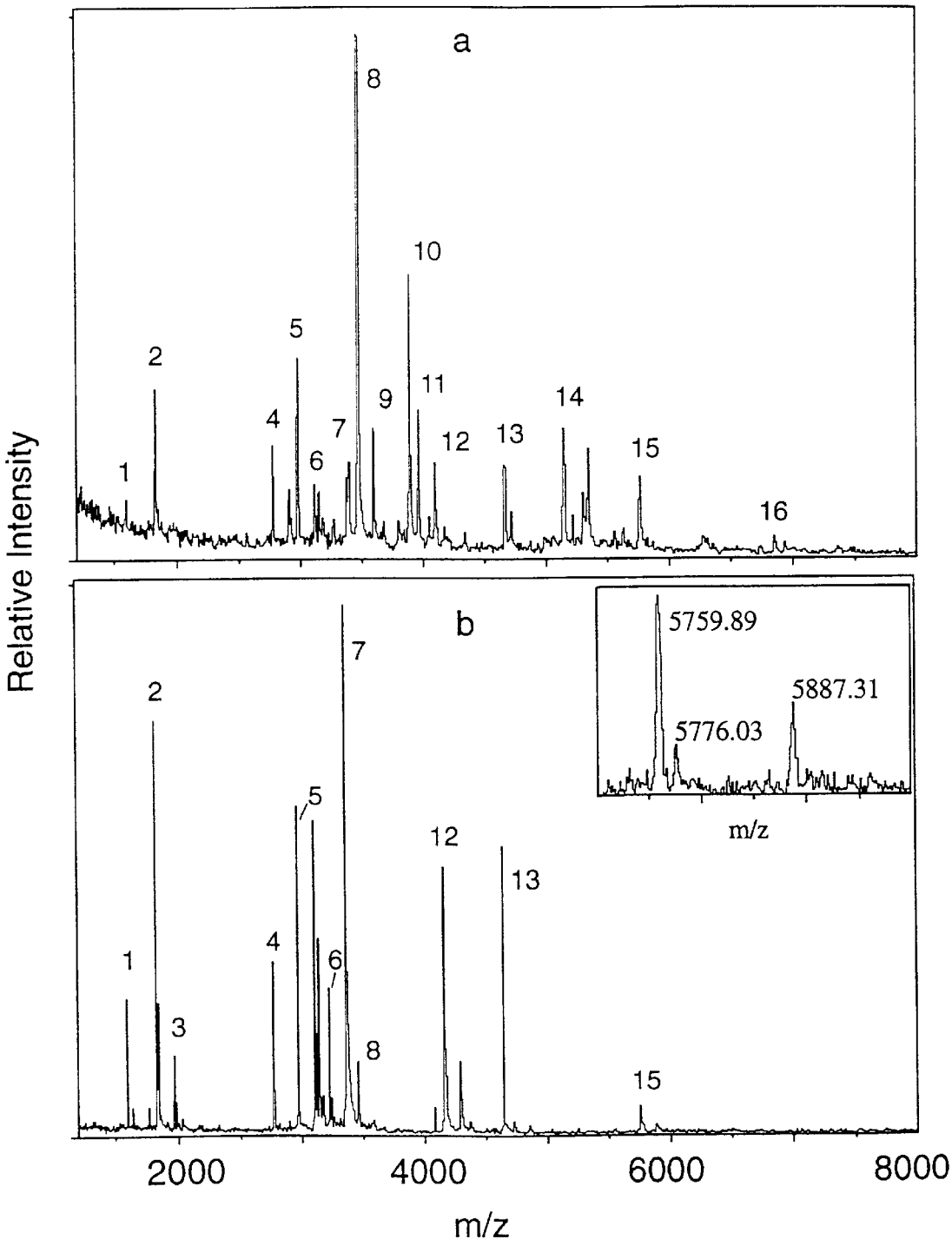
FIG. 10 is a MALDI-TOF mass spectra of tryptic digest products of citrate synthase (*a*) after a 2 minute digest performed directly on-membrane (PU) and (*b*) a 3 hour digest performed in an Eppendorf™ tube analysed on the PU membrane with delayed extraction MALDI-MS.

Table 1 is the mapping of selected tryptic fragments of citrate synthase from FIG. 10.

Table 2 is the mapping of selected tryptic fragments of human hemoglobin from FIG. 14C.

DETAILED DESCRIPTION

Figure 1:
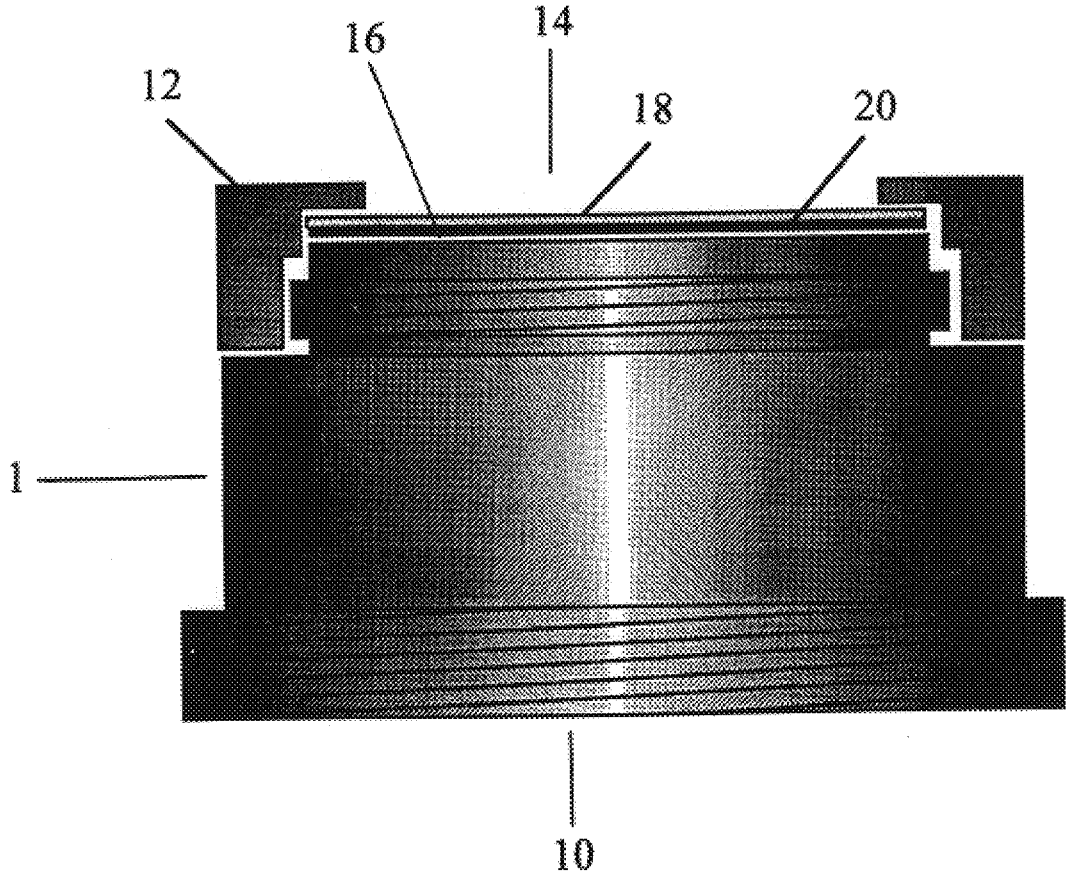
FIG. 1 is a side view of the MALDI-TOFMS probe.

Referring to FIG. 1, the non-porous probe 1 comprises a probe body 10 and a non-porous membrane 14. The details of the probe body 10 are not shown as the probe body 10 is a target stage of a mass spectrometer and is therefore known in the art. In this embodiment, the probe body 10 comprises a probe cap 12 and a support disk 16. The probe cap 12 is arranged to be fitted onto the probe body 10 so as to secure the non-porous membrane 14 to the probe body 10 as described below. In this embodiment, the non-porous membrane 14 comprises non-porous ether-type PU membrane 18, 50 $\mu$m in thickness (catalog number XPR625-FS, from Stevens Elastomerics, Northampton, Mass., USA) and the support disk 16 comprises a silver disk 20.

Figure 2:
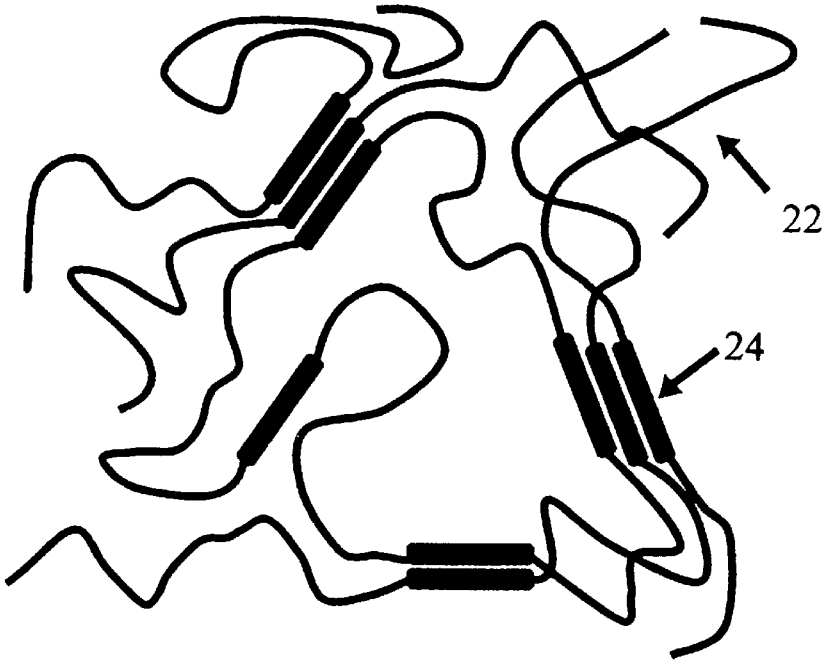
FIG. 2 is an example of the structure of polyurethane (PU) in a membrane.
Figure 2:
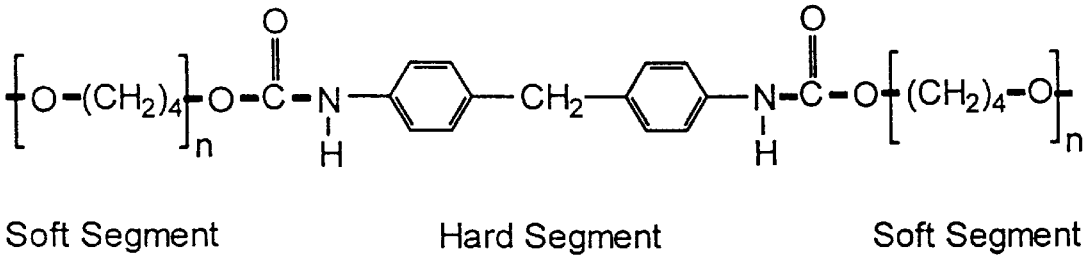

For MALDI-TOFMS analysis, the non-porous probe 1 is assembled as follows. The PU membrane 18 is washed with water and methanol prior to use. Sample preparation is based on the dried-drop method (Karas and Hillenkamp, 1988, *Anal. Chem.* 60:2299). 2 $\mu$l of an analyte-containing solution is placed on the PU membrane 18 and allowed to dry slowly. 2 $\mu$l of methanol is added to the dried analyte and also dried. The addition of methanol to samples deposited on the PU membrane 18 causes swelling of the polyurethane which leads to enhanced protein sorption. Specifically, addition of methanol may cause disruption of the intermolecular forces holding the polymer chains together, thereby allowing an increase in the effective surface area available for protein sorption. Methanol also facilitates the partition of proteins and peptides from more polar components, for example salts. At this stage, the dried analyte may be washed by applying 20 $\mu$l aliquots of deionized, filtered water obtained from a Barnstead Nano-Pure™ water filtration system to the dried analyte and then removing the water repeatedly at intervals of one minute. 2 $\mu$l of matrix solution (sinapinic acid saturated in 70:30 water-acetonitrile) is then added and allowed to crystallize slowly. At this time, the silver disk 20 is coated with a thin layer of adhesive. After the matrix dries, the PU membrane 18 is placed on the silver disk 20, excess PU membrane 18 is trimmed away from the silver disk 20 and the silver disk 20 is placed onto the probe body 10 for MALDI analysis as described below. Alternatively, because the analyte-containing solution is dried onto the PU membrane 18, the PU membrane 18 can be stored and/or sent to the MALDI laboratory for analysis. The physical properties of the membrane facilitates its transfer through regular mail service allowing ease of transport from distant outside locations to the MALDI laboratory. Furthermore, samples can be applied directly to the PU membrane 18 for analysis without dilution or pre-treatment, thereby reducing sample loss and degradation and improving accuracy and sensitivity of the MALDI analysis. As shown in FIG. 2, PU membranes 18 possess a unique two-phase structure consisting of hydrophobic soft domains 22 and relatively hydrophilic hard domains 24. The hard domains 24 are microcrystalline regions on the surface of the polymer, where the isocyanate portions of the polymer chains are aggregated by hydrogen bonding between the carbamate groups on adjacent polymer chains. These hard domains 24 are relatively polar in comparison to the soft segment domains 22. The soft domains 22 consist of long chain polyethers which are relatively amorphous in character compared with the hard domains 24. The two-phase structure of the polyurethane elastomer provides two different regions of possible membrane-protein interactions, differing in polarity and in ability to form hydrogen bonds. Hydrogen bonding with the hard domains 24 and hydrophobic interactions with the soft domains 22 are believed to take place between the protein and the PU membrane 18, resulting in relatively strong binding (Sreenivasan et al., 1992). Furthermore, as noted above, the PU membranes 18 have a uniform surface, allowing for greater sensitivity and accuracy.

Alternatively, the probe body may comprise a commercially available MALDI probe having a flat, metallic surface to which the non-porous membrane is affixed using an adhesive. The non-porous membrane is then trimmed to fit the surface of the probe body prior to sample application.

Alternatively, the non-porous membrane may be affixed to a commercial probe body using an adhesive.

Alternatively, other washing solutions known in the art, for example, acidified water (a dilute trifluoroacetic acid solution, formic acid or acetic acid) may be used instead of water.

It is of note that any of the matrix solutions known in the art may be used in place of sinapinic acid.

Alternatively, additional sample may be applied to the membrane to further concentrate the sample prior to the addition of matrix solution.

In other embodiments, the analyte may be extracted from a mixture of samples and/or impurities and concentrated onto the membrane by placing the membrane in a solution containing the analyte. The solution may be a biological solution, for example, whole blood, blood plasma, cerebral fluid, spinal fluid, saliva, or tears. Furthermore, the above-described process may be carried out in vivo.

In other embodiments, the membrane is dissolved in a solvent and then applied directly to the probe body, thereby forming a film on the probe body. The sample is then applied to the film as described above.

The use of PU membranes as sample supports for MALDI-TOFMS analysis of peptides and proteins as well as for the analysis of whole blood is described in the Examples listed below. It is of note that other membrane compounds if prepared so as to be non-porous, may be suitable for use as non-porous membrane MALDI sample supports. Furthermore, it is of note that non-porous membranes may be used, for example, as supports for MALDI analysis of blood plasma, cerebral fluid, spinal fluid, saliva, tears and other biofluids as well as for enviro-monitoring and the like.

EXAMPLE I

Preparation of Samples for Peptide and Protein Mass Spectrometry

Solutions of horse heart myoglobin (16,951 Da), bovine insulin (5,733 Da) and bovine serum albumin (66,430 Da) obtained from Sigma Chemicals (St. Louis, Mo., USA) and bovine apotransferrin (78,030 Da) obtained from Calbiochem (LaJolla, Cailf., USA) were made up in deonizied, filtered water ($10^{-4}$–$10^{-6}$ M) and used without further purification. The samples were prepared and applied to the PU membrane 18 as described above.

EXAMPLE II

MALDI-TOFMS Analysis of Samples

MALDI-TOFMS was performed in the linear mode on Manitoba II, an instrument constructed in our laboratory, using an accelerating potential of 25 kV. In order to avoid saturation of the detector by low mass matrix ions, the detector voltage was pulsed on, ~19,000 ns after each laser shot. Delayed extraction experiments were performed on the same instrument with a delay time of 700 $\mu$s with a pulse height of 3 kV and an accelerating potential of 20 kV. Spectra were obtained using a nitrogen laser (337 nm) with a pulse width of 3 ns, and a fluence adjusted slightly above threshold. Each spectrum presented here results from the sum of either 50 or 100 consecutive laser shots. Furthermore, external and internal calibration modes were used. For comparison purposes samples were also applied to a metallic target and a PVDF membrane. In all cases, external calibrations for measurements using the various MALDI supports were performed with standards prepared on similar targets.

EXAMPLE III

Comparison Between PU and Metal

Figure 3:
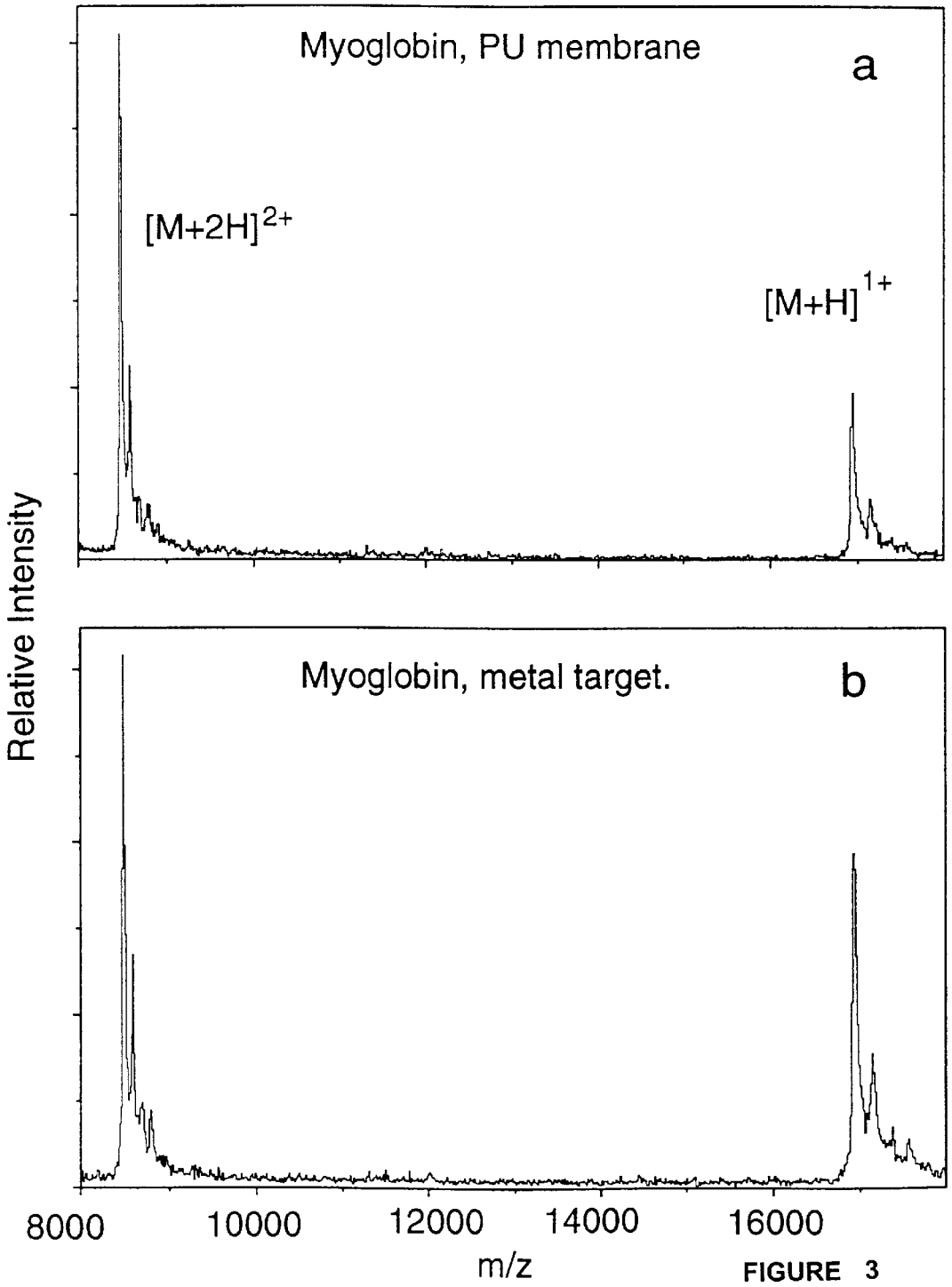
FIG. 3 is the MALDI-TOF mass spectra of myoglobin using (*a*) a PU membrane and (*b*) a metallic target.

FIG. 3 shows MALDI-TOF mass spectra of 50 pmol of myoglobin using a PU membrane (FIG. 3*a*) and a metallic target (FIG. 3*b*). As can be seen, the spectra are essentially identical. It is of note that while equivalent resolution and mass accuracy were obtained, preparation of impure samples for MALDI analysis using PU membranes is much faster and simpler than preparation of the same samples on metallic probes. In addition, as noted above, samples bound to PU membranes do not need to be shipped on ice and may be stored at ambient temperatures.

EXAMPLE IV

Comparison Between PU, Metal and PVDF

Figure 4:
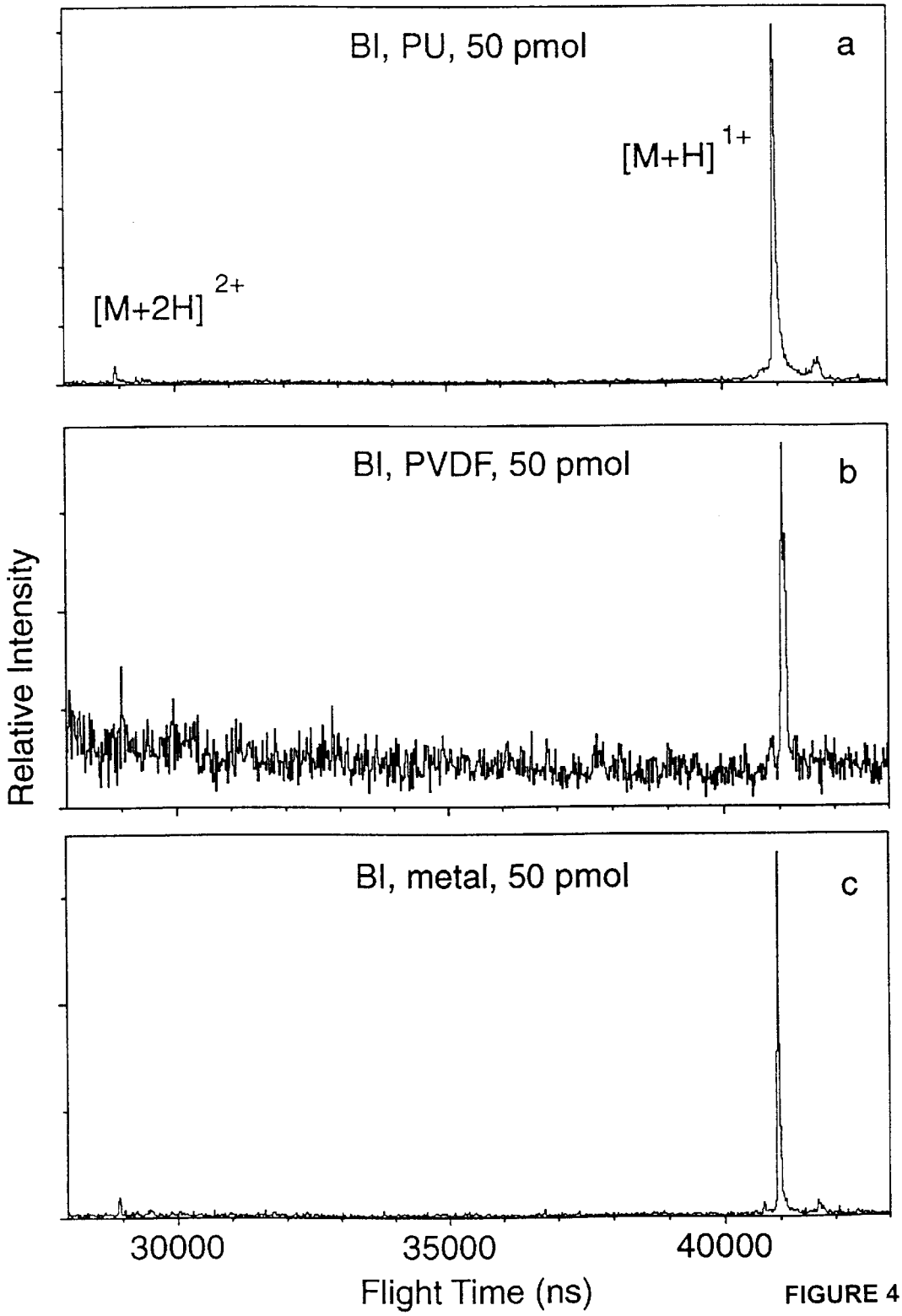
FIG. 4 is the MALDI-TOF mass spectra of 50 pmol bovine insulin using (*a*) a PU membrane, (*b*) a PVDF membrane and (*c*) a metallic target.
Figure 5:
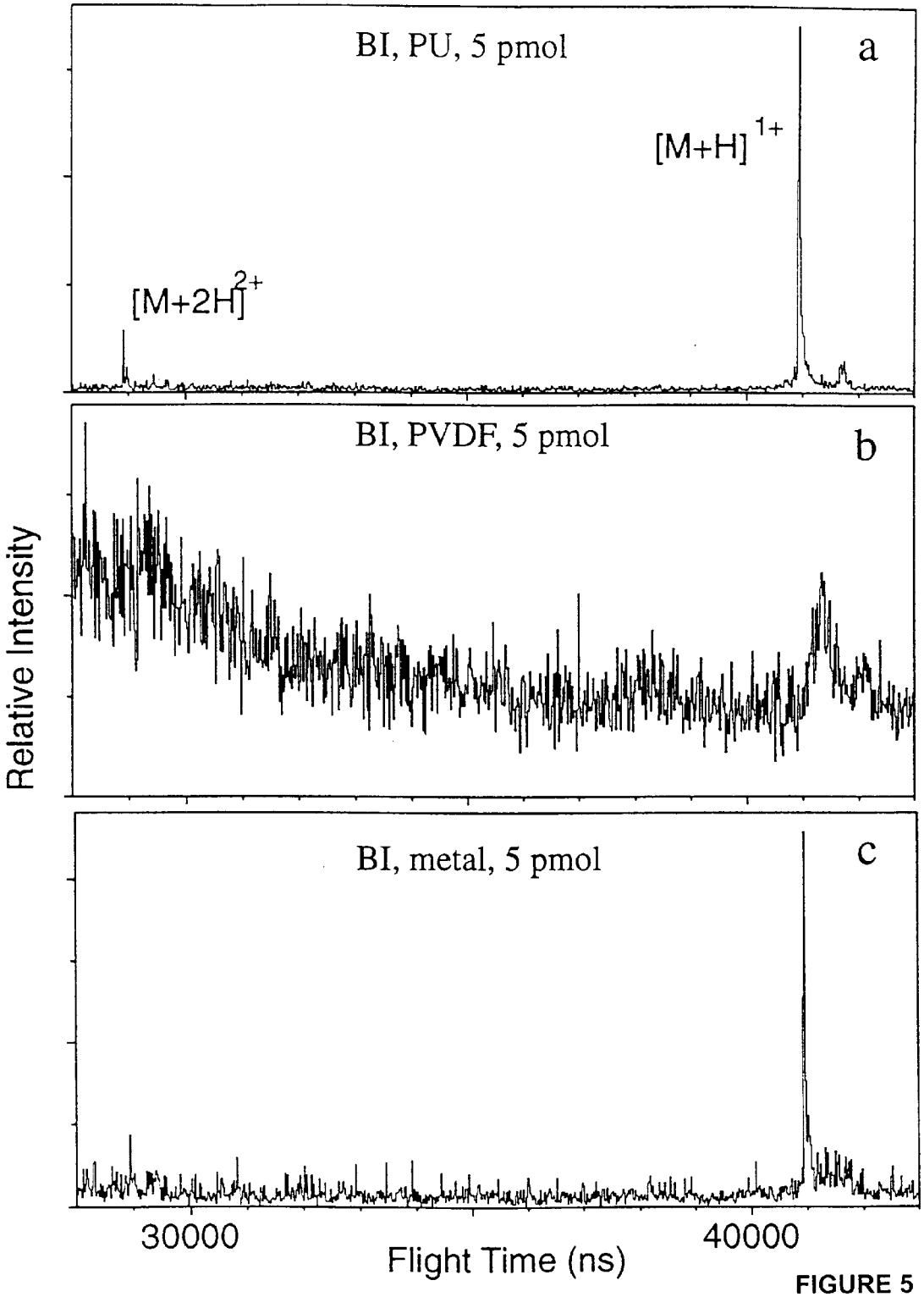
FIG. 5 is the MALDI-TOF mass spectra of 5 pmol bovine insulin using (*a*) a PU membrane, (*b*) a PVDF membrane and (*c*) a metallic target

FIG. 4 shows MALDI-TOF mass spectra of 50 pmol of bovine insulin obtained using a PU membrane (FIG. 4*a*), a PVDF membrane (FIG. 4*b*) and a metallic target (FIG. 4*c*). As can be seen, the PU membrane and the metallic target yield equivalent resolution and mass accuracy for bovine insulin. However, the mass accuracy observed with the PVDF membrane was inferior. A comparison was also made with 5 pmol of bovine insulin (FIG. 5). In this case, PU (FIG. 5*a*) and the metallic target (FIG. 5*c*) yielded comparable spectra to that observed with 50 pmol of sample while the PVDF (FIG. 5*b*) membrane again produced a poor quality spectrum. In the case with PVDF, the laser intensity required to obtain ionization threshold was higher than that required for PU and the metal target. This was attributed to the porosity of PVDF, which permits distribution of the analyte and matrix within the membrane (Blackledge and Alexander, 1995, *Anal. Chem.* 67:843). This may necessitate an increase in the laser irradiance in order to sample within the pores and the higher irradiance results in the emission of more ions which results in charging. The charging, in addition to a non-uniform initial starting point for ions, reduces the spectral quality by reducing the resolution. In comparison, the non-porous nature of the PU membrane, as with a metallic target, favours crystal growth on the surface of the membrane only, thereby providing enhanced spectral quality over membranes with porous structures. Thus, the non-porous membranes provide improved spectra compared to porous membranes. In fact, the quality is similar to that obtained with the metallic targets.

EXAMPLE V

Comparison of Flight Times for PU and PVDF

Figure 6:
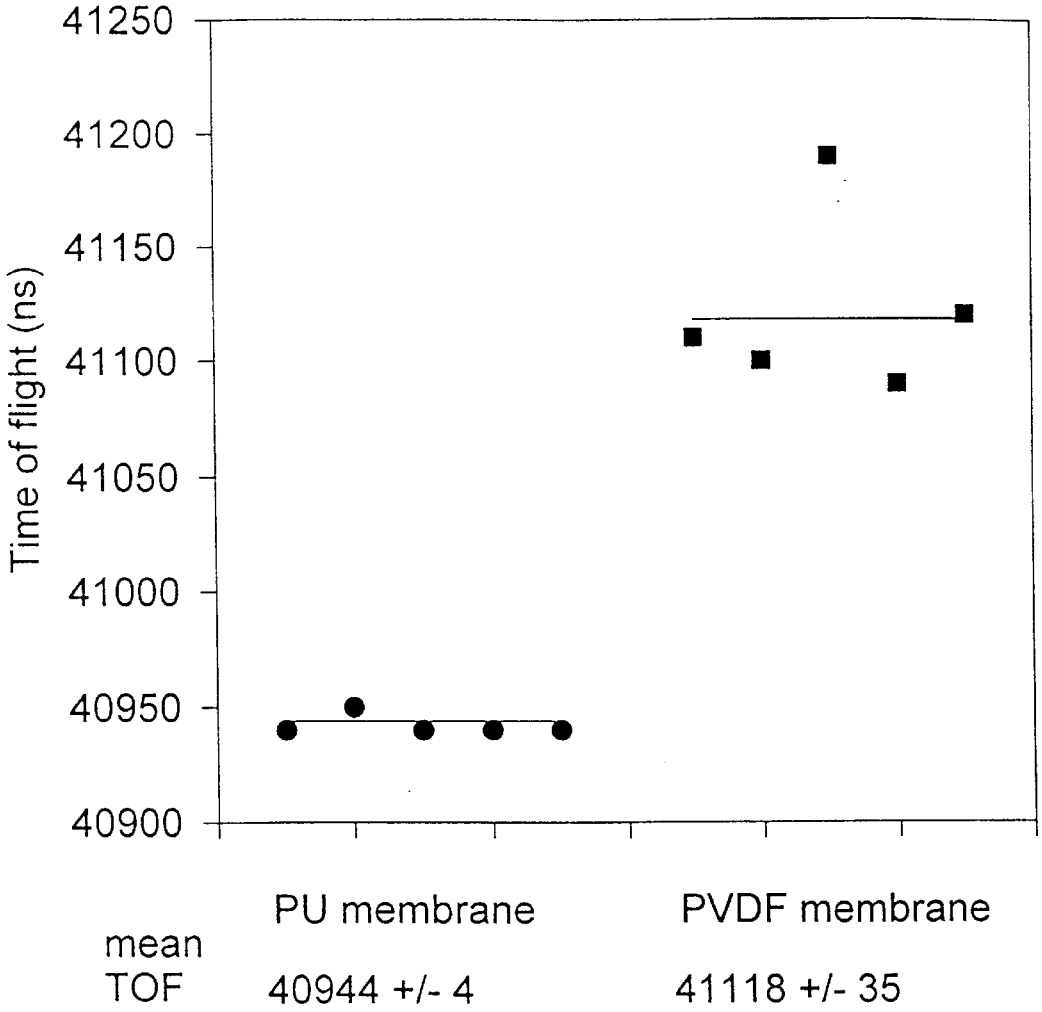
FIG. 6 is a comparison of measurements of the flight times of bovine insulin between a PU membrane and a PVDF membrane.

FIG. 6 shows the distribution in the flight times for bovine insulin ions desorbed from PU and PVDF membranes. It is of note that the distribution for the PU membrane shows a similar variance to what is typically obtained on a metal target and a smaller variance than observed for ions desorbed from PVDF membranes. In general, peak shapes were better on PU membranes compared to metal targets, making centroid assignment more systematic. This was possibly due to partitioning of the bound protein molecules from interfering adducts, for example, salts, which can affect the position of the peak centroid. PU-deposited samples were also tolerant of a large range of laser intensities, without observation of peak broadening due to charging or adduct formation. Conversely, a larger variance in flight times was observed with PVDF due to the spatial distribution of sample within the pores and the larger laser intensity required to generate spectra.

EXAMPLE VI

Comparison of PU and Metal Using NaCl-doped Solutions

Figure 7:
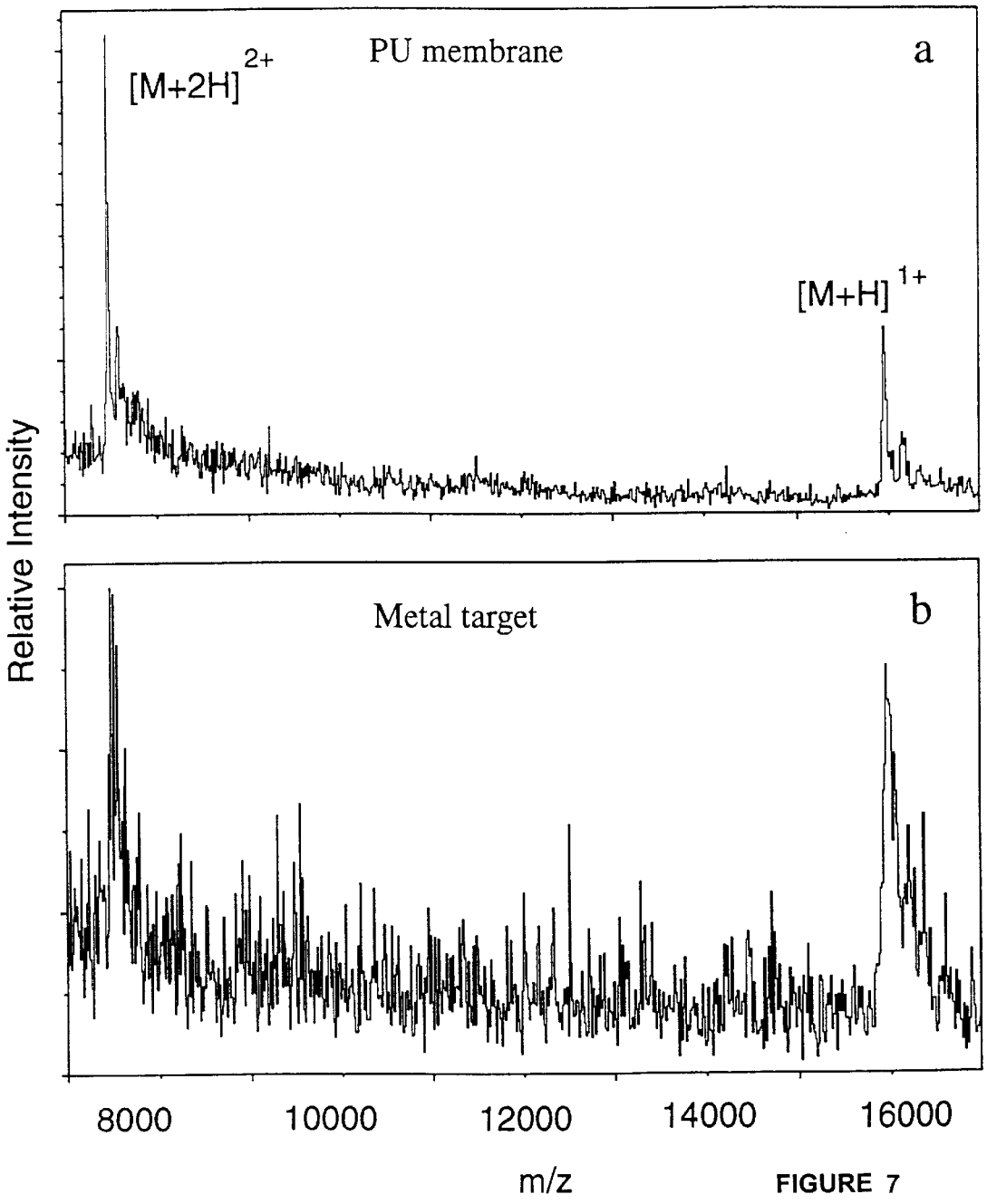
FIG. 7 is the MALDI-TOF mass spectra of myoglobin in the presence of NaCI using (*a*) a PU membrane and (*b*) a metallic target.

FIG. 7 shows mass spectra of 200 pmol of myoglobin with 200 nmol of NaCl obtained using a PU membrane (FIG. 7*a*) and a metallic target (FIG. 7*b*). As can be seen, use of PU membranes brought a substantial improvement to the quality of the data obtained compared with metal targets for the analysis of NaCl-doped solutions. It is apparent that selective partitioning of the protein molecules, NaCl, and matrix components between the aqueous phase and the surface of the PU membrane likely occurs, as some areas of the target produced good quality spectra even in the presence of excess NaCl. This was not the case with the metal target. This clearly shows that not only does the PU membrane provide comparable spectra quality to the metallic targets, in some instances, such as samples with high salt concentrations, provide spectra of higher quality than metallic targets.

EXAMPLE VII

Washing Protocol

Figure 8:
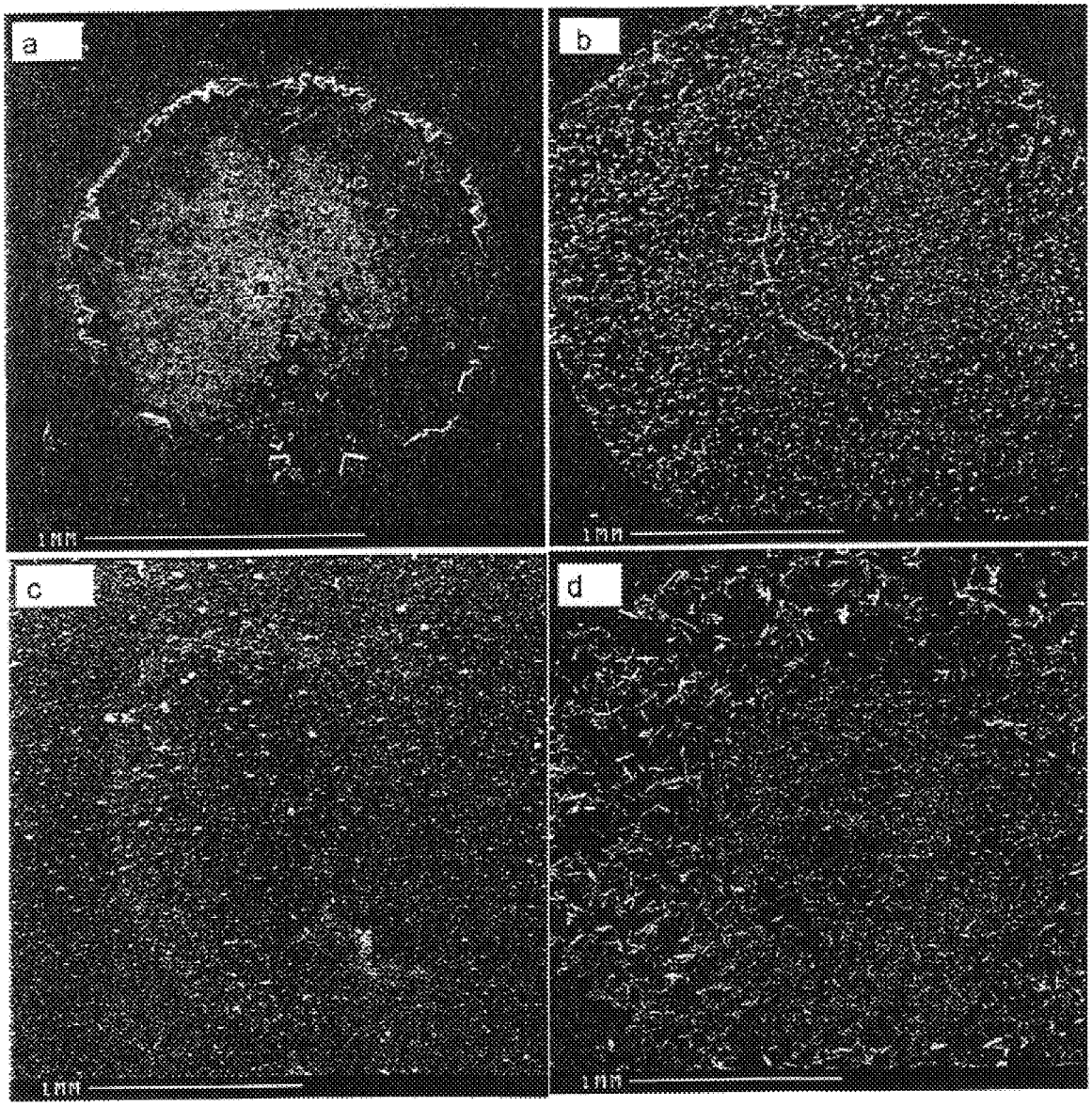
FIG. 8 is scanning electron micrographs of myoglobin samples in the presence of NaCl on a PU membrane (*a*) untreated, (*b*) with matrix solution added, (*c*) following one wash and (*d*) following two washes and addition of matrix solution.

Scanning electron micrographs of 200 pmol myoglobin samples in the presence of 200 nmol NaCl on a PU membrane are shown in FIG. 8. Application of NaCl-containing solutions to PU membranes resulted in a marked difference in the crystallization patterns of the protein and NaCl mixture before washing, after washing and with addition of matrix solution, as shown in FIG. 8. Prior to washing (FIG. 8*a*), NaCl is visible on the surface. After addition of matrix (FIG. 8*b*), disrupted crystallization is observed, due to the presence of the NaCl. Following one washing step (FIG. 8*c*), the visible amount of NaCl is removed and only a small amount of sample containing salt remains on the membrane. After two or more washing steps, protein and salt are not visible by scanning electron microscopy on the membrane surface. However, a sufficient amount of protein remains bound to the membrane as MALDI still produces strong signals. After washing, the addition of matrix (FIG. 8*d*) results in the formation of analyte-matrix crystals, typical of a clean sample which will produce a good MALDI spectrum.

Figure 9:
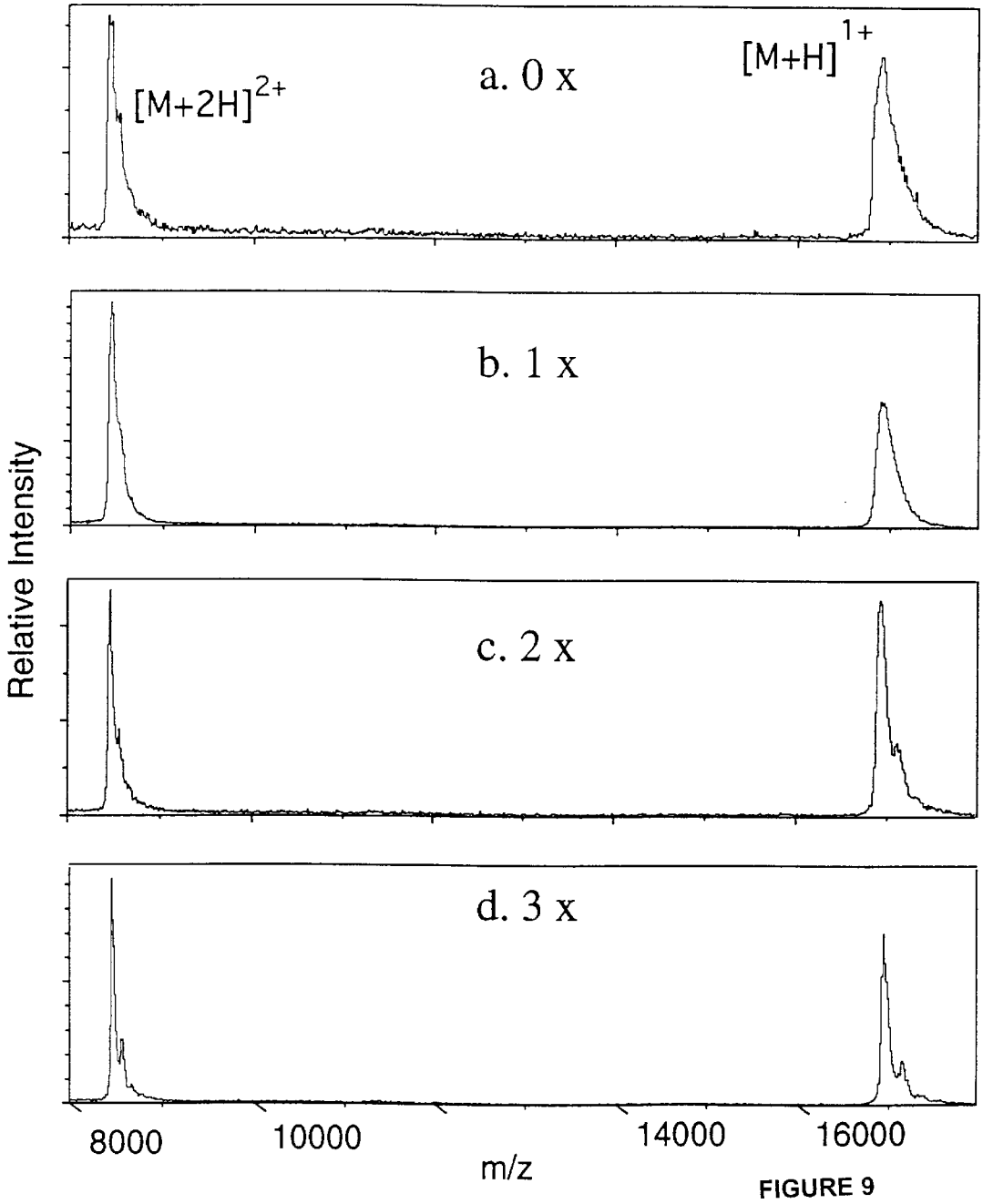
FIG. 9 is the MALDI-TOF mass spectra of myoglobin in the presence of NaCl using a PU membrane (*a*) untreated, (*b*) after one wash, (*c*) after two washes, and (*d*) after three washes.

FIG. 9 shows the MALDI-TOF mass spectra of 200 pmol of myoglobin in the presence of 200 nmol of NaCl on a PU membrane untreated (FIG. 9*a*), and washed once (FIG. 9*b*), twice (FIG. 9*c*) and three (FIG. 9*d*) times. As can be seen from FIG. 9, the relatively strong interactions of the PU membrane with proteins and peptides enable the introduction of a washing step. Specifically, samples of myoglobin were prepared in a 1000-fold excess of NaCl and applied to the membrane. In this case MALDI spectra were obtained using a wide laser beam to ensure sampling of the entire surface of the target including areas which contained NaCl, myoglobin and matrix. An overall improvement in peak shape and resolution was observed with increasing numbers of washes, as shown in FIGS. 9*a–d*. The peaks in the spectrum of the untreated sample (FIG. 9*a*) correspond to Na adducts. These adducts cause peak broadening and make accurate mass assignment difficult. After successive washing steps, the peaks become narrower as the abundance of Na adducts decreases with the removal of NaCl. The resulting increase in resolution enables correct mass assignment.

Thus, as shown in FIGS. 8 and 9, the PU membranes bind the analytes tightly enough to allow washing of the membrane, which in turn results in improved spectral quality. While porous membranes also allow the use of washing steps, each time the analyte is solubilized in buffer, wash solution or matrix solution, the analyte is further distributed into the membrane. This distribution of analyte within the porous surface reduces the amount of analyte available near the top of the membrane for sampling with the laser to bring about a MALDI-MS spectrum. Thus, increased laser irradiance is required to penetrate deep into the pores. This increased laser irradiance results in charging which causes an increase in the flight time, which significantly reduces spectral quality compared with metallic targets and the PU membrane. The distribution also results in a non-uniform initial starting point for ions, again reducing the spectral quality by reducing the resolution.

EXAMPLE VIII

On-Membrane Proteolytic Digestion of Citrate Synthase

Figure 11:
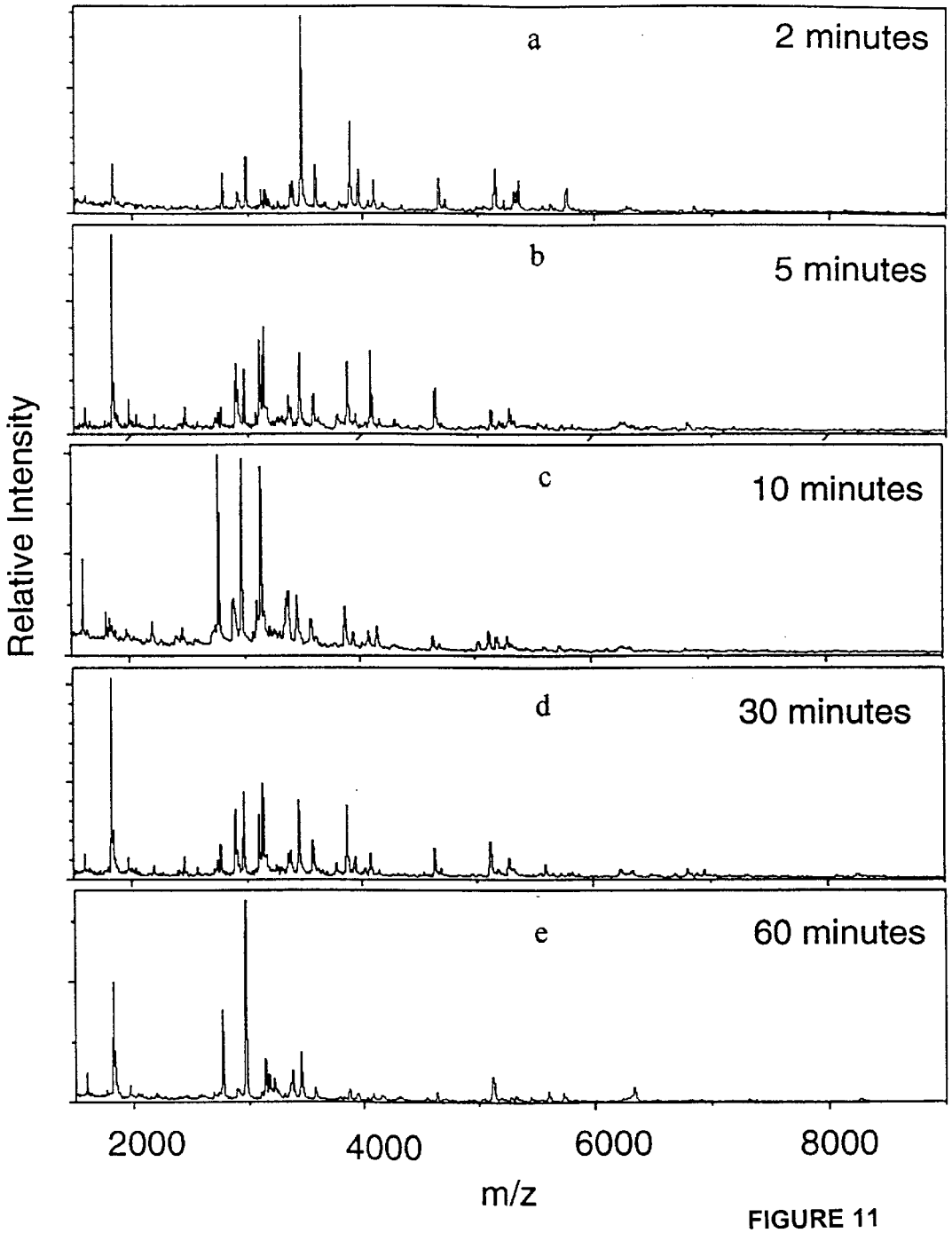
FIG. 11 is the MALDI-TOF mass spectra of tryptic digest products of citrate synthase after (*a*) a 2 minute, (*b*) a 5 minute, (*c*) a 10 minute, (*d*) a 30 minute and (*e*) a 60 minute digestion performed directly on the PU membrane.

FIG. 10 shows the MALDI-TOF mass spectra of the tryptic digest products of 40 pmol of citrate synthase following a 2 minute digest performed directly on-membrane (FIG. 10*a*) and a 3 hour digest performed in an Eppendorf™ tube followed by analysis using delayed extraction (FIG. 10*b*). FIG. 11 shows the MALDI-TOF mass spectra of tryptic digest products of citrate synthase after 2 minutes (FIG. 11*a*), 5 minutes (FIG. 11*b*), 10 minutes (FIG. 11*c*), 30 minutes (FIG. 11*d*) and 60 minutes (FIG. 11*e*) of digestion performed directly on a PU membrane. In this manner, application of our membrane methodology to real samples was carried out by performing tryptic digests of citrate synthase directly on the PU membrane and comparing the results to those obtained from samples digested in Eppendorf™ tubes (FIG. 10*b*). It is of note that similar spectra were obtained for samples digested in Eppindorf™ tubes and on the PU membrane (FIG. 10), indicating that digestion of citrate synthase was not hindered as a result of citrate synthase binding to the PU membrane. Furthermore, most segments of the protein were mapped against calculated fragments, shown in Table 1, thereby providing further evidence that tryptic digestion was not hindered.

Digests were also performed for periods of time varying from 2–60 minutes directly on the PU membrane (FIG. 11). Good quality MALDI spectra were observed following removal of the buffer components with the washing protocol described above. Over the duration of the digest, the initially abundant high mass ions were replaced with lower mass ions (FIG. 11*a–e*). Furthermore, it is of note that the protein underwent significant digestion after only two minutes. This may indicate that the protein denatures upon sorption and drying on the PU membrane, thus facilitating rapid digestion.

The 3 hour proteolytic digestion was used to investigate the advantages of using delayed extraction with samples deposited on the PU membrane. The results presented in FIG. 10*b* indicate a peak profile similar to the earlier digest profiles. The use of delayed extraction resulted in a substantial increase in resolution as shown in the inset where the oxidation product of the compound, producing a peak at m/z 5759, may be observed. This enabled confirmation of the mass assignments as shown in Table 1. Furthermore, this procedure is simply not possible with metallic targets without the use of extensive sample pre-treatment in order to remove the salts which will interfere with the MALDI process.

EXAMPLE IX

Application to High Mass Proteins

Figure 12:
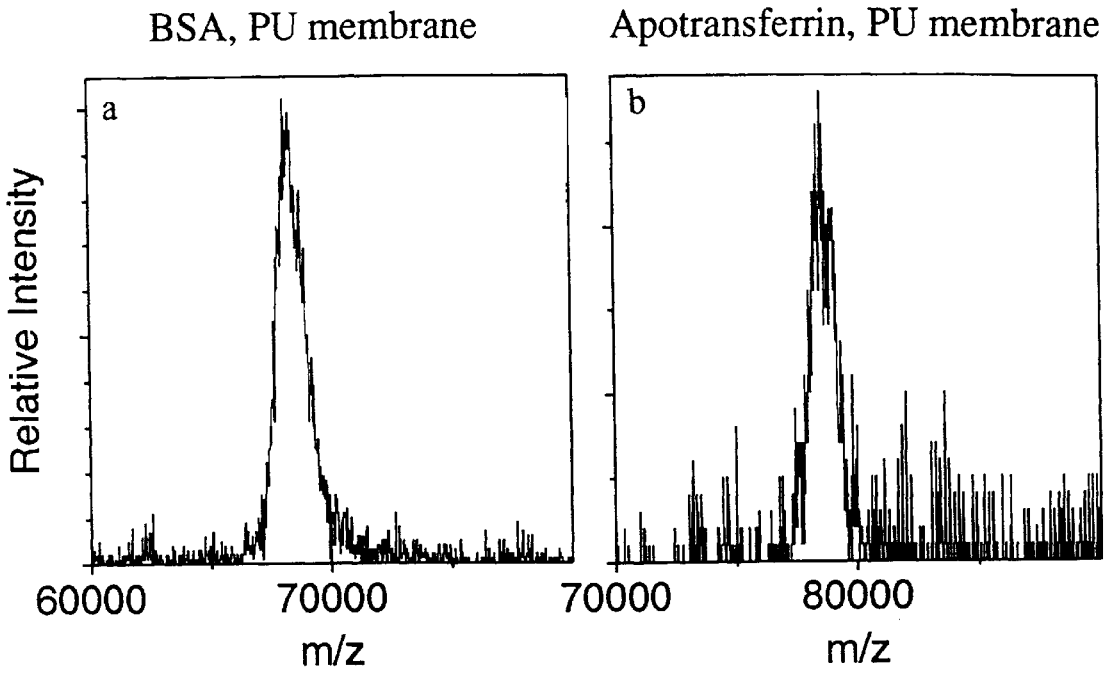
FIG. 12 is the MALDI-TOF mass spectra of (*a*) bovine serum albumin and (*b*) apotransferrin using PU membranes.

FIG. 12 shows MALDI-TOF mass spectra of 20 pmol of high molecular weight proteins bovine serum albumin (FIG. 12*a*) and apotransferrin (FIG. 12*b*) on PU membranes. Specifically, high molecular weight proteins may be defined as those with a mass greater than 20,000 Da. The results obtained are comparable to those obtained using the metallic target. While a slight increase in observed mass was observed for the samples deposited on the PU membrane, this is likely due to charging and to use of external calibration. This phenomenon was observed only for higher m/z values and may be corrected with calibration in similar experimental conditions. Thus, PU membranes may be used for MALDI-TOFMS analysis of high molecular weight proteins and peptides.

EXAMPLE X

Application to Whole Blood Analysis

Figure 13:
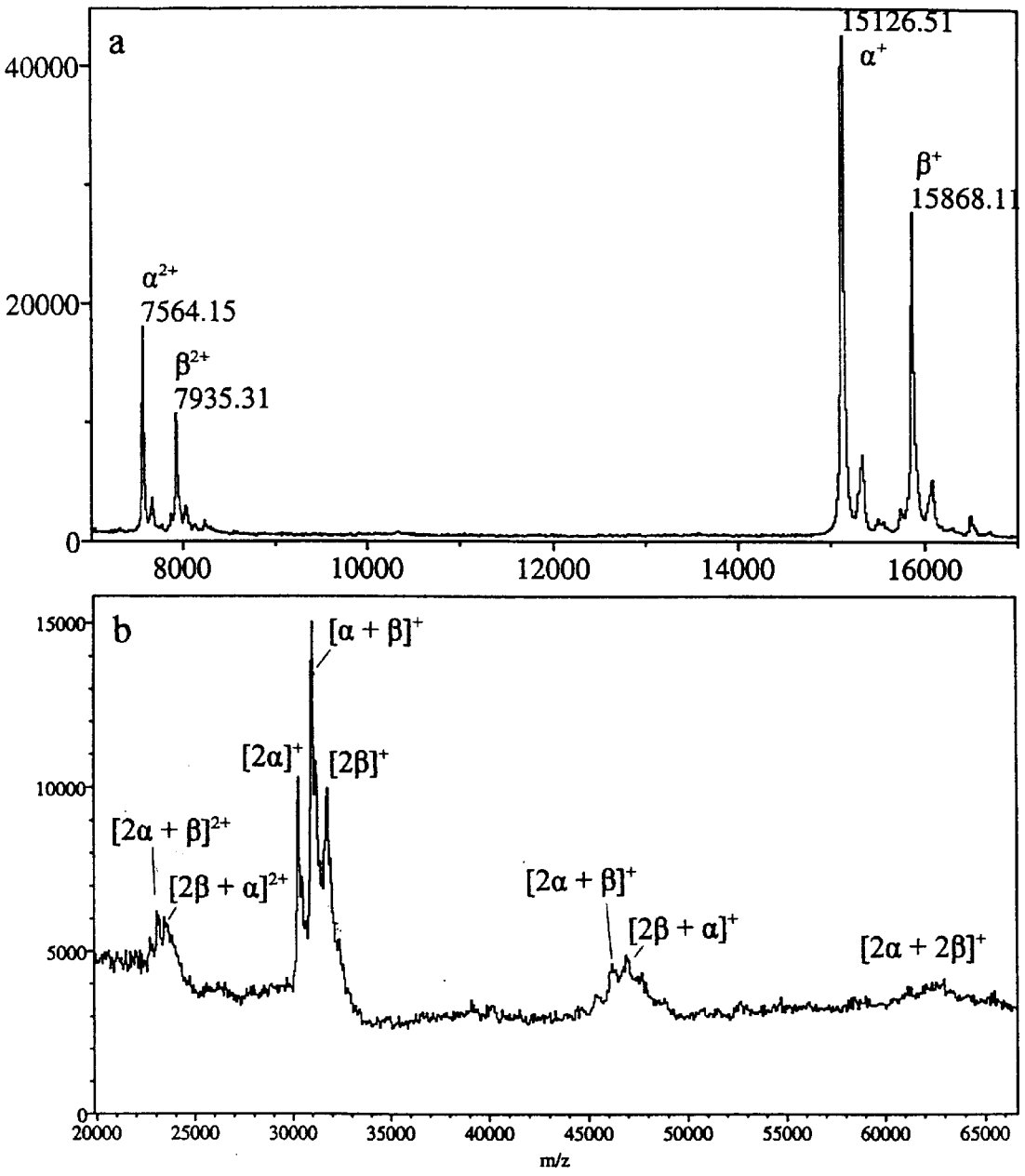
FIG. 13 is the MALDI mass spectra of the alpha and beta chains of hemoglobin.
Figure 14:
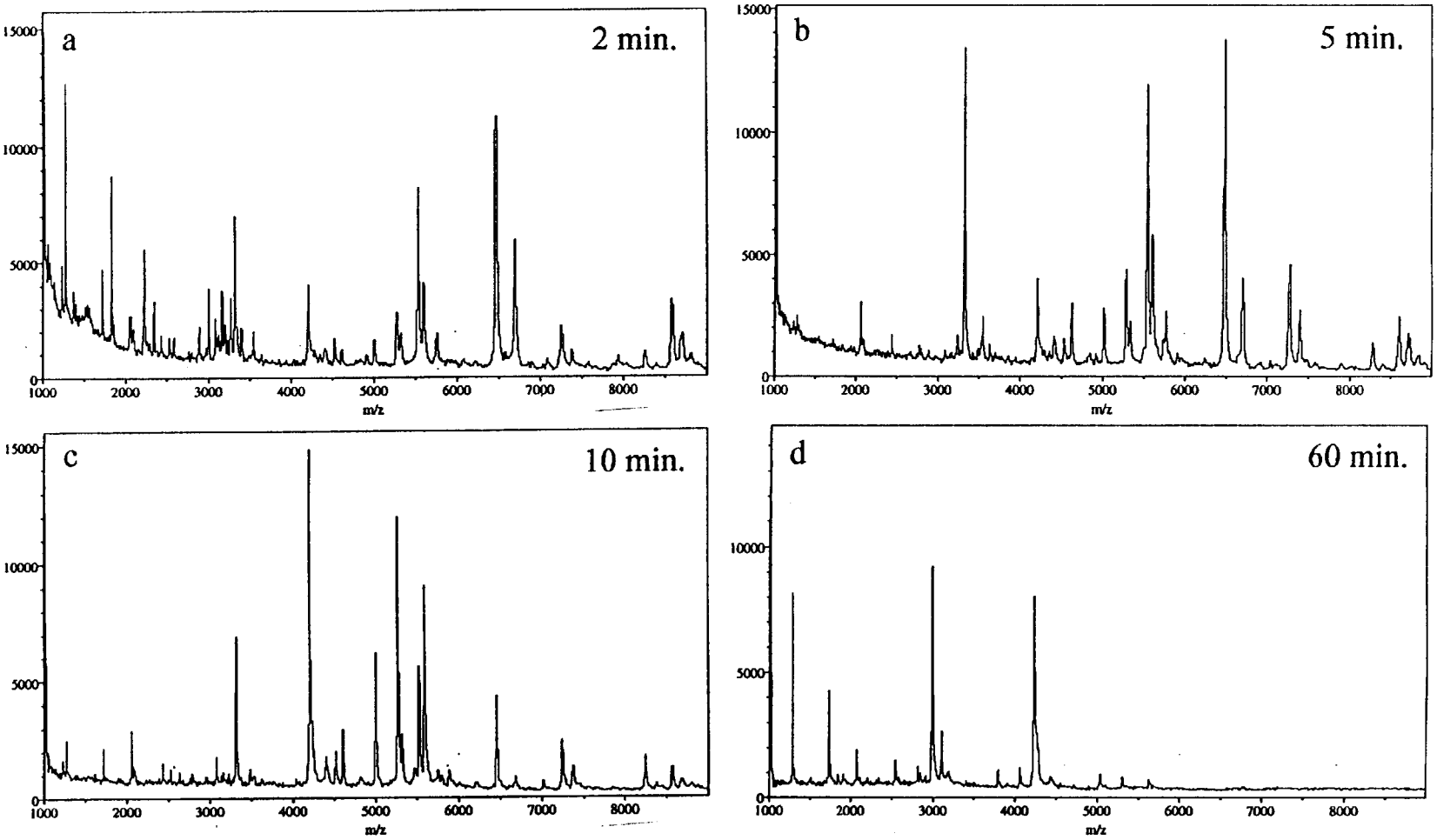
FIG. 14 is the MALDI-TOF mass spectra of the alpha and beta chains of human hemoglobin digested on-membrane (PU) with trypsin for (*a*) 2 minutes, (*b*) 5 minutes, (*c*) 10 minutes and (*d*) 60 minutes.

FIG. 13 shows MALDI-TOF mass spectra of the alpha and beta chains of human hemoglobin. Approximately 0.5 μl of whole blood, that is, a droplet of blood, was collected directly onto the PU membrane and allowed to dry. The sample was then washed as described above. Spectra were acquired in linear mode with external calibration. Peaks correspond to alpha and beta chains of hemoglobin, in +1 and +2 charge states. FIG. 14 shows the MALDI-TOF mass spectra of the alpha and beta chains of human hemoglobin following trypsin digestion of 2 minutes (FIG. 14*a*), 5 minutes (FIG. 14*b*), 10 minutes (FIG. 14*c*) and 60 minutes (FIG. 14*d*). The sample was digested directly on the membrane with trypsin. Spectra were acquired in linear mode with calibration performed internally on known peaks. The peak assignments corresponding to those observed for the 10 minute digest (FIG. 14*c*) are given in table 2. Clearly, the spectra obtained are of good quality, indicating that the PU membranes may be used for MALDI-TOFMS analysis of whole blood. In addition, hemoglobin variants may be rapidly and easily characterized.

DISCUSSION

As can be seen from the above Examples, the use of PU membranes as sample supports for MALDI-TOFMS analysis of proteins and peptides yields equivalent accuracy and resolution to values obtained with metallic targets and, produces superior resolution when, for example, analysing impure samples. Specifically, it is the non-porous nature of the membrane that facilitates crystal growth on the surface of the membrane only and thus provides for enhanced spectral quality over porous membranes. Furthermore, the relatively strong interactions of the PU membranes with bound proteins and peptides enables the introduction of a washing step in order to remove salt and buffer components which may interfere with MALDI analysis. As a result, the quality of the spectra obtained may be improved by repeated washes. Finally, tryptic digestion of citrate synthase performed on the membrane surface yielded characteristic fragments, allowing for successful peptide mapping.

It is of note that the above-described experiments were carried out using standard analytes under controlled conditions. Clearly, this does not in any way predict success for use of MALDI-TOFMS analysis of more complex solutions, such as biological fluids. However, we have now applied our PU membrane technology for the analysis of whole blood by MALDI-TOFMS. A sample is acquired in an outside location by a health care practitioner as follows: a lancet is used to prick a person's finger and the droplet of blood is collected directly onto the pre-washed PU membrane simply by touching the finger to the membrane. The sample is then allowed to dry under ambient conditions. A chemical modifier may be added, for example, methanol, acetic acid or the like to disrupt coagulation, or digestion may be performed at this time. The sample is then sent to a (distant) laboratory for MALDI-TOF analysis. Sample preparation in the mass spectrometry lab is simple and may be performed by an inexperienced person according to the above-described protocol. That is, 2 μl of methanol is applied to the dried sample on the membrane and the membrane is allowed to dry. The sample is then washed one to three times with cold water. Matrix solution is added and allowed to dry. The sample is then affixed to a target and placed in the mass spectrometer for MALDI-TOF analysis. If desired, proteolytic digestion of the sample may be performed directly on the membrane prior to the washing step in order to obtain more information about the sample. As noted above, this may be done at the time of sample acquisition or at any time thereafter. Digestion proceeds according to the protocol described in Example IX. That is, between 2 and 10 μl of a 1 mg/ml solution of a proteolytic enzyme, for example trypsin, in buffer is added to the blood sample directly on the membrane and mixed with the sample. Digestion may be performed for varying periods of time from 2 minutes to more than 60 minutes, dependant upon the extent of digestion required.

Figure 15:
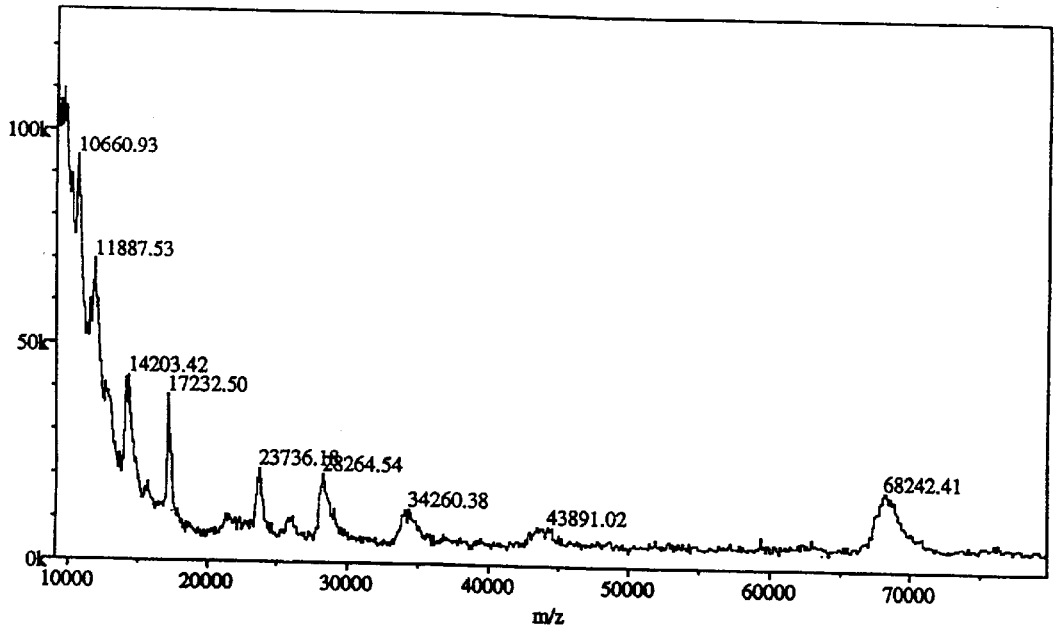
FIG. 15 is the MALDI-TOF mass spectrum of freshly collected canine plasma on PU membrane, using conditions similar to in vivo, i.e. in vitro conditions.
Figure 16:
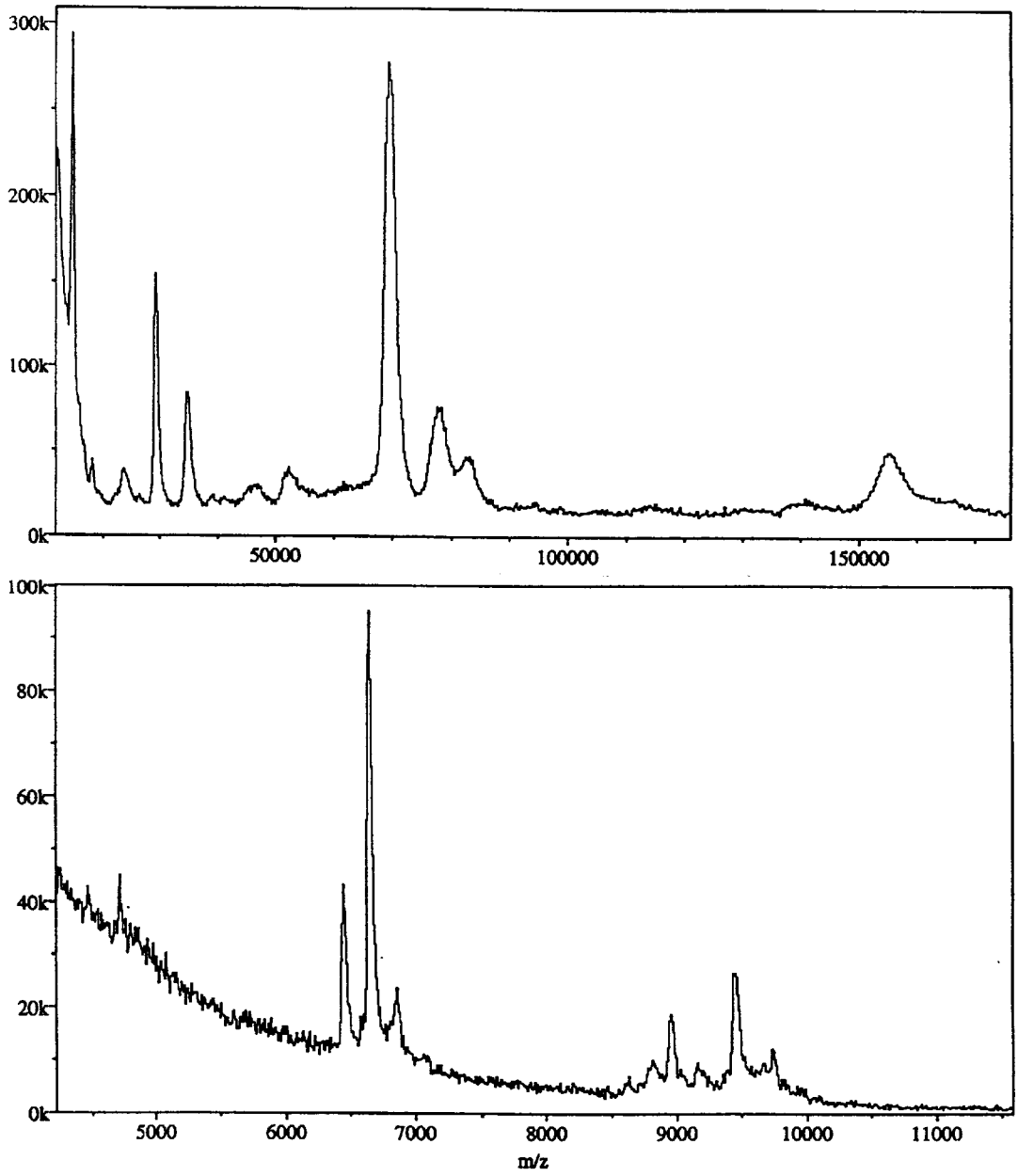
FIG. 16 is the MALDI-TOF mass spectrum of human plasma standard on PU membrane.

As can be seen in FIG. 13, good quality MALDI mass spectra of whole blood can be obtained and are comparable to those of purified samples. Furthermore, the procedure is easy to follow and may be performed by an inexperienced user. Sample manipulation is facilitated by using the membrane, as liquid samples are not required. Analysis is rapid with minimal time required for hands on preparation. Samples may be collected in any setting with a lancet and a small piece of PU membrane. The analysis is sensitive because there is minimal loss of sample during the digestion process and washing steps, as the entire process is performed on the membrane. Furthermore, using a PU membrane with MALDI adds an insignificant cost to the analysis. Finally, on-membrane digestion followed by database mapping will facilitate the identification of abnormal amino acid sites in the sequences of the alpha and beta hemoglobin chains, since spectra of intact chains may yield insufficient information. Furthermore, we have results of MALDI-TOFMS analysis of human plasma standards (FIG. 16) and fresh plasma from canine samples exposed under conditions similar to in vivo, i.e. in vitro conditions (FIG. 15). Several plasma proteins were observed to bind to the PU membrane and were characterized, as shown in FIGS. 15 and 16. This application to plasma demonstrates that PU may be used as model biomaterial and that this procedure may be used to model protein sorption in-vivo.

It is of note that in other embodiments, membranes composed of other polymers may be used, provided the membranes are manufactured so as to be non-porous. Furthermore, in other embodiments, any of the appropriate proteolytic enzymes known in the art may be used for on-membrane digestion of the sample. Finally, it is of note that non-porous membranes may be used, for example, as supports for analyzing blood plasma, cerebral fluid, spinal fluid, saliva, tears and other biofluids as well as for enviromonitoring and the like.

Since various modifications can be made in our invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A method of performing matrix-assisted laser desorption/ionization time of flight mass spectrometry analysis on an analyte sample comprising:

(a) providing a non-porous membrane as a sample support;

(b) providing a matrix solution;

(c) applying the analyte sample directly to the non-porous membrane;

(d) allowing the analyte sample to dry;

(e) applying the matrix solution to the dried analyte sample;

(f) allowing the matrix solution to dry;

(g) mounting the non-porous membrane onto a probe body;

(h) inserting the probe body and the non-porous membrane into a mass spectrometer; and (i) carrying out MALDI-TOFMS analysis of the analyte sample.

2. The method according to claim 1 wherein the non-porous membrane is composed of polyurethane.

3. The method according to claim 1 including the steps of adding a chemical modifier to the analyte sample after step (c).

4. The method according to claim 1 wherein the analyte sample is whole blood.

5. The method according to claim 1 wherein in step (c) the analyte sample comprises a droplet of blood and said droplet is applied directly to the non-porous membrane.

6. The method according to claim 3 wherein the chemical modifier is an anticoagulant.

7. The method according to claim 1 including the step of washing the analyte sample prior to step (e).

8. The method according to claim 1 including the steps of adding a proteolytic enzyme in a buffering solution to the analyte sample, allowing digestion of the analyte sample to occur and removing the buffering solution by washing the analyte sample prior to step (e).

9. The method according to claim 1 including extracting the analyte sample from a mixture comprising the analyte sample and impurities.

10. The method according to claim 9 wherein the analyte solution is extracted from the mixture by placing the non-porous membrane into the mixture.

11. The method according to claim 1 wherein the analyte solution is a biofluid.

12. The method according to claim 11 wherein the biofluid is selected from the group consisting of: whole blood; blood plasma; cerebral fluid; spinal fluid; saliva; and tears.

* * * * *